United States Patent [19]

Ziolo et al.

[11] Patent Number: 4,810,611

[45] Date of Patent: Mar. 7, 1989

[54] DEVELOPER COMPOSITIONS WITH COATED CARRIER PARTICLES HAVING INCORPORATED THEREIN COLORLESS ADDITIVES

[75] Inventors: Ronald F. Ziolo; Paul C. Julien, both of Webster, N.Y.

[73] Assignee: Xerox Corporation, Stamford, Conn.

[21] Appl. No.: 115,806

[22] Filed: Nov. 2, 1987

[51] Int. Cl.[4] ..... G03G 9/10

[52] U.S. Cl. ..... 430/106.6; 430/108

[58] Field of Search ..... 430/108, 110, 106.6

[56] References Cited

U.S. PATENT DOCUMENTS

| | | | |
|---|---|---|---|
| 3,533,835 | 10/1970 | Hagenbach et al. | 117/217 |
| 4,026,703 | 5/1977 | Hayashi et al. | 430/127 |
| 4,133,933 | 1/1979 | Sekine et al. | 428/328 |
| 4,275,103 | 1/1981 | Tsubusaki et al. | 428/128 |
| 4,601,967 | 7/1986 | Suzuki et al. | 430/107 |
| 4,672,016 | 6/1987 | Isoda et al. | 430/108 |

*Primary Examiner*—John L. Goodrow

*Attorney, Agent, or Firm*—E. O. Palazzo

[57] ABSTRACT

A developer composition comprised of a toner composition having dispersed therein resin particles, pigment particles, and carrier particles comprised of a core with a coating thereover, which coating has incorporated therein colorless copper iodide enabling carriers with a conductivity of from about $10^{-6}$ to $10^{-8}$ ohm-cm.

29 Claims, No Drawings

DEVELOPER COMPOSITIONS WITH COATED CARRIER PARTICLES HAVING INCORPORATED THEREIN COLORLESS ADDITIVES

BACKGROUND OF THE INVENTION

This invention is generally directed to developer compositions, and more specifically the present invention is directed to the incorporation of specific carrier particles into developer compositions. Therefore, in one embodiment the present invention is directed to coated carrier particles having incorporated therein colorless components, such as certain metal halides, primarily for the purpose of achieving a specific conductivity value range for the aforementioned particles. In one embodiment of the present invention, the developer compositions are comprised of toner resin particles, pigment particles, carrier particles with a coating thereover such as those selected from polymeric compositions especially those derived from vinyl homopolymers and copolymers, and incorporated into the coating specific metal halides. The aforementioned developer compositions, which are particularly useful in electrophotographic imaging processes, provide developers which substantially eliminate contamination of the imaging apparatus within which they are incorporated; and also these compositions have desirable conductivity values and excellent charge admixing times.

The xerographic process involves the development of latent images by developer compositions comprised of toner resin particles, pigment particles, and carrier particles. Numerous different developer compositions are described in the prior art, inclusive of those with toner resin particles comprised of styrene acrylate copolymers, styrene butadiene copolymers, styrene methacrylate copolymers, polyesters, and the like. Additionally, there is disclosed in the prior art the selection of various carrier particles, both coated and uncoated, for use as a component in a developer composition. Moreover, it is known that charge enhancing additives can be incorporated into various developer compositions for the purpose of imparting the desired charge polarity to the toner resin particles.

There are disclosed in U.S. Pat. No. 3,795,617 carrier particles containing magnetically attractable core particles with a resinous vinylidene chloride copolymer coating thereon. Illustrative examples of copolymeric materials selected are outlined in column 5, beginning at line 4, and include, for example vinylidene chloride, acrylonitrile, and acrylic acid terpolymers. Additionally, it is indicated in this patent that useful results can be obtained by substituting one or more alkyl esters of acrylic or methacrylic acid for the acrylonitrile component of the copolymer, which esters typically have from about 1 to 18 carbon atoms in the alkyl group, inclusive of methyl methacrylate, ethyl methacrylate, and butyl methacrylate.

Further, there are disclosed in U.S. Pat. No. 4,310,611 novel magnetic carrier components comprised of a mass of passivated particles of magnetic stainless steel with a thin tightly adherent chromium rich layer. It is indicated in column 2, beginning at line 35 of this patent, that optionally the passivated particles can have a coating of a resin which aids in the triboelectrical charging of the toner, but which is discontinuous or thin enough to allow the particle mass to remain conductive. Also, examples of resins selected as carrier coatings include those described in U.S. Pat. Nos. 3,795,617; 3,795,618; and 4,076,857. Specific examples of carrier coatings listed in column 4 of the U.S. Pat. No. 3,795,617 include fluorocarbon polymers such as polytetrafluoroethylene, polyvinylidene fluoride, and polyvinylidenefluoride-co-tetrafluoroethylene.

In U.S. Pat. No. 4,374,192 there are disclosed novel carrier coatings with miscible mixtures of a butadiene acrylonitrile rubber, and containing from about 20 percent to about 40 percent of acrylonitrile together with a polyurethane elastomer. These coatings, according to the teachings of this patent, are tough, tenacious, and not tacky, reference the disclosure in column 4, beginning at line 3.

Many other patents are in existence disclosing toner and carrier particles, representative of which include U.S. Pat. No. 4,051,077, relating to developer compositions with various additives; U.S. Pat. No. 4,298,672, the disclosure of which is totally incorporated herein by reference, which discloses positively charged developer compositions comprised of resin particles, pigment particles, alkyl pyridinium charge enhancing additives, and carrier particles; U.S. Pat. No. 3,627,522, the disclosure of which is totally incorporated herein by reference, directed to developer compositions with carrier particles coated with terpolymer resins of styrene, methylmethacrylate, and an organo silane; U.S. Pat. No. 3,923,503, the disclosure of which is totally incorporated herein by reference, disclosing methods of imaging with developer compositions comprised of steel carrier particles coated with various resins, such as polymethylmethacrylate, polyvinylidene fluoride, and terpolymers of styrene; and U.S. Pat. No. 3,526,533, the disclosure of which is totally incorporated herein by reference, directed to carriers with coatings of linear addition copolymers of polymerized polystyrene, polymerized acrylates, or polymerized methacrylates, and polymerizable organo silicon compositions.

Of particular interest with respect to the invention of the present application are the carrier particles illustrated in U.S. Pat. No. 3,533,835, the disclosure of which is totally incorporated herein by reference, which particles are comprised of a core with a coating thereover, and wherein the coating contains therein numerous conductive substances such as silver iodide, which iodide decomposes into an undesirable black color as contrasted to copper iodide which is colorless, and does not decompose. While the substances of the U.S. Pat. No. 3,533,835 are suitable for their intended purposes, they generally are not colorless as is the situation with the additive incorporated into the carrier coatings of the present invention; and furthermore, with the invention of the present application, there are enabled other advantages such as avoiding contamination of the imaging apparatus, excellent admixing times in some embodiments, and acceptable conductivity values.

Also of interest are U.S. Pat. No. 4,133,933, which discloses electrosensitive recording sheets in which cupric iodide is selected as an electroconductive material, which iodide particles can be whitened by an aqueous akaline material; U.S. Pat. No. 4,275,103, which discloses an electographic recording sheet wherein metal oxide semiconductors that are virtually colorless are selected, examples of such semiconductors including tin oxide, dye indium trioxide, and zinc oxide; and U.S. Pat. No. 4,601,967 directed to toner particles consisting of an electroconductive core in a coating layer, which coating layer may comprise copper iodide in the form of a powder iron, nickel, cobalt, or manganese, reference for example column 3, lines 3 to 9.

Accordingly, there is a need for developer compositions wherein there are selected carrier coatings having incorporated therein colorless conductive additives. There is also a need for carrier particles that possess desirable conductivity values which are achievable by incorporating into the carrier coatings specific colorless components thereby avoiding color contamination, a problem with some prior art carrier coatings wherein, for example, carbon black is selected as the conductivity controlling component that is incorporated into the carrier coating. In addition, there is a need for developer compositions with carrier coatings having incorporated therein specific colorless conductive components, which compositions maintain their triboelectric charging characteristics for extended time periods.

SUMMARY OF THE INVENTION

It is an object of the present invention to provide developer compositions with many of the above advantages.

In another object of the present invention there are provided developer compositions with coated carrier particles having incorporated therein colorless components.

Furthermore, in another object of the present invention there are provided developer compositions with coated carrier particles having incorporated therein certain colorless metal halide conductive components thereby permitting specific acceptable conductivity values for the carrier particles.

Moreover, in yet another object of the present invention there are provided for incorporation into developer compositions durable carrier particles with coatings of specific vinyl polymers including vinyl homopolymers and vinyl copolymers, and wherein there is incorporated into these coatings certain colorless metal halide conductive components.

Additionally, in another object of the present invention there are provided developer compositions useful for the development of electrostatic latent images in xerographic imaging processes.

In addition, another object of the present invention resides in the provision of coated carrier particles having incorporated therein specific colorless conductive components thereby resulting in carrier particles with conductivity values of from about $10^{-6}$ to about $10^{-8}$ ohm-cm.

These and other objects of the present invention are accomplished by the provision of improved developer compositions comprised of resin particles, pigment particles, and specific carrier particles. More specifically, in accordance with the present invention there are selected coated carrier particles having incorporated therein specific colorless conductive components. Accordingly, in one embodiment of the present invention there are provided improved developer compositions comprised of resin particles, pigment particles, and carrier particles comprised of a core with a coating thereover, which coating has incorporated therein colorless copper iodide components.

With further respect to the present invention, similar developer compositions are illustrated in related application U.S. Ser. No. 751,922, entitled Developer Composition With Specific Carrier Particles, wherein there are selected coated carriers having incorporated therein various dopants such as carbon black for the primary purpose of controlling the conductivity of carrier particles, the disclosure of the aforementioned application being totally incorporated herein by reference. Some of the coatings of the aforementioned application, particularly carbon black, are not colorless and thereby could have a tendency to contaminate the developer composition causing undesirable modifications of these compositions including, for example, a reduction in the conductivity parameters, and a decrease in the triboelectric charging properties.

Various suitable known toner compositions can be selected for the developer compositions of the present invention including compositions comprised of resin particles and pigment particles. Examples of suitable toner resins selected are as illustrated in U.S. Pat. No. 4,298,672, the disclosure of which is totally incorporated herein by reference, inclusive of styrene polymers, styrene methacrylates, styrene acrylates, and styrene acrylonitriles, as well as styrene butadiene polymers and polyesters, reference U.S. Pat. No. 3,590,000, the disclosure of which is totally incorporated herein by reference. Various styrene butadienes can be selected especially those commercially available from Goodyear Chemical as Pliolite$^R$. Generally, the styrene butadiene resin used comprises from about 80 percent by weight to about 92 percent by weight of styrene, and from about 8 percent by weight to about 20 percent by weight of butadiene. Particularly preferred are styrene butadiene resins of a molecular weight of from about 80,000 to about 140,000, a glass transition temperature of from about 51° to about 63° C., and a molecular weight distribution of from about 5.5 to 8.5. Other examples of styrene butadiene resin copolymers useful as a component in the developer composition of the present invention include those as prepared by the process as described in U.S. Pat. Nos. 4,558,108 and 4,469,770, the disclosures of each of the aforementioned patents being totally incorporated herein by reference.

Numerous known suitable pigments or dyes can be selected as the colorant for the toner particles including, for example, carbon black, magnetites, nigrosine dye, chrome yellow, DuPont oil red, phthalocyanine blue, and mixtures thereof. These pigments, excluding magnetites, should be present in a sufficient amount to render the toner composition highly colored, thus enabling the formation of a clearly visible image on a recording member. For example, where conventional xerographic copies of documents are desired, the pigment particles are present in amounts of from about 3 percent by weight to about 20 percent by weight, based on the total weight of the toner composition; however, lesser or greater amounts of pigment particles can be selected providing the objectives of the present invention are achieved. Preferably, from about 5 percent by weight to about 15 percent by weight of pigment particles are incorporated into the toner compositions of the present invention.

With respect to magnetite pigments comprised of iron oxides, they are present in the toner composition in various amounts inclusive of, for example, from about 5 percent by weight to about 25 percent by weight, and preferably from about 10 percent by weight to about 20 percent by weight, based on the weight of the toner composition. Moreover, there can be incorporated into the developer composition of the present invention flow aid additives inclusive of Aerosil, and aluminum oxides, especially $Al_2O_3$ and Cabosil$^R$. These flow additives can be blended into the toner composition or are present as external materials in amounts of from about 0.1 percent by weight to about 5 percent by weight, and preferably in an amount of from about 0.1 percent by weight to about 2 percent by weight.

Various suitable cores can be selected for the carrier particles including steel, iron, ferrites, especially nickel-zinc-ferrites, and the like. The preferred carrier core is steel. Generally, the carrier core is of a diameter of from about 35 microns to about 500 microns, and preferably is of a diameter of from about 80 microns to about 150 microns.

Coatings selected for the carrier particles of the present invention are comprised of certain vinyl polymers, and other components, reference the patents and copending application mentioned herein. Examples of polymers include copolymers and homopolymers of vinylchloride and trifluorochloroethylene; Saran F-310; vinylchloride/maleate ester; vinylchloride and vinylacetate; trifluorochloroethylene and vinylidenefluoride; vinylchloride and acrylonitrile; vinylchloride/-chlorotrifluoroethylene (FP461); and other equivalent coatings. One preferred coating is comprised of a copolymer of vinylchloride and trifluorochloroethylene with about 65 percent by weight of vinylchloride, and 35 percent by weight of trichlorofluoroethylene monomer. Moreover, the coating polymers of the present invention are preferably of a weight average molecular weight exceeding 10,000, and more preferably are of a weight average molecular weight of from about 40,000 to about 80,000.

The coatings applied to the carrier cores can be of any suitable thickness providing the objectives of the present invention are achieved, however, generally the coating is present in a thickness of from about 0.1 to about 1 micron, and preferably from about 0.1 to about 0.5 micron. Usually the coating is present on the entire surface of the carrier core, that is it is continuous; however, the coating can also be semicontinuous providing each of the carrier core particles have a minimum of about 0.3 percent by weight of the polymeric coating composition.

Incorporated into the aforementioned carrier coatings are colorless components selected from certain colorless conductive metal halides, which components are added in an amount of from about 25 percent by weight to about 75 percent by weight, and preferably in an amount of from about 50 percent by weight to about 70 percent. Examples of metal halides that may be selected include copper iodide, copper fluoride, mixtures thereof, and the like.

Although it is not desired to be limited by theory, it is believed that the colorless coatings enable developer compositions with the improved characteristics as detailed herein including, for example, triboelectric charging values of from about 15 microcoulombs per gram to about 30 microcoulombs per gram for extended time periods; a conductivity of from about $10^{-6}$ to about $10^{-8}$ (ohm-cm)$^{-1}$; and more importantly, the conductive additives selected for the carrier coatings are colorless thereby eliminating any contamination of the resulting developer compositions.

There can also be incorporated into the toner compositions of the present invention comprised of resin particles and pigment particles charge enhancing additives such as alkyl pyridinium halides, organic sulfate and sulfonate compositions, and other charge enhancing additives, reference the U.S. patents previously mentioned herein. Particularly preferred charged enhancing additivies include cetyl pyridinium chloride, distearyl dimethyl ammonium methyl sulfate, stearyl phenethyl dimethyl ammonium tosylate, and the like. These additives assist in providing a positive charge to the resulting toner compositions enabling such compositions to be especially useful in xerographic imaging apparatuses having incorporated therein negatively charged layered photoresponsive imaging members as illustrated in U.S. Pat. No. 4,265,990, the disclosure of which is totally incorporated herein by reference.

Normally, from about 3 to about 5 parts by weight of toner composition are added to about 100 to 200 parts by weight of carrier particles for enabling formation of the developer composition. Specifically, the developer compositions are prepared by mixing together in a suitable vessel from about 3 to 10 parts by weight of toner particles with from 100 to 200 parts by weight of carrier particles.

The toner composition of the present invention can be prepared by a number of known methods, including melt blending the toner resin particles, pigment particles, and charge enhancing additive followed by mechanical attrition. Other methods include those well known in the art, such as spray drying, melt dispersion, dispersion polymerization, extrusion processing, and suspension polymerization. In one dispersion polymerization method, a solvent dispersion of the resin particles, the pigment particles, and the charge enhancing additive are spray dried under controlled conditions resulting in the desired product.

Also, the toner and developer compositions of the present invention may be selected for use in electrophotographic imaging apparatuses, including those as described in U.S. Pat. Nos. 4,368,970 and 4,394,429, the disclosure of each of these patents being totally incorporated herein by reference. According to the teachings of these patents, there is selected a development system for incorporation into a xerographic imaging apparatus comprised of a moving deflected tensioned flexible imaging member, a moving transporting member, a development zone situated between the imaging member and transporting member, these members being maintained at a distance of from about 0.5 millimeter to about 1.5 millimeters, wherein toner particles are desirably agitated in the development zone, thereby allowing these particles to be readily available in a continuous manner to the imaging member.

Examples of photoconductive members selected for the imaging apparatuses within which the toner and developer compositions of the present invention are incorporated include amorphous selenium, selenium alloys, such as selenium arsenic, selenium tellurium, selenium antimony, and the like; and organic photoreceptors, illustrative examples of which include layered photoresponsive devices comprised of transport layers and photogenerating layers, reference U.S. Pat. No. 4,225,990, the disclosure of which is totally incorporated herein by reference, and other similar layered photoresponsive devices. Illustrative examples of generating layers include trigonal selenium, metal phthalocyanines, metal free phthalocyanines, and vanadyl phthalocyanines, while examples of charge transport layers include the diamines as disclosed in the U.S. Pat. No. 4,225,990.

The following examples are being submitted to further define various species of the present invention, it being noted that these examples are intended to illustrate and not limit the scope of the present invention.

Parts and percentages are by weight unless otherwise indicated.

EXAMPLE I

There was prepared a toner composition by admixing in a Banbury apparatus 94 percent by weight of a styrene n-butyl methacrylate copolymer containing 58 percent by weight of styrene, and 42 percent by weight of n-butyl methacrylate; and 6 percent by weight of Regal® 330 carbon black. Subsequently, the resulting toner composition was classified to remove particles smaller than 5 microns average diameter. Thereafter, the aforementioned prepared toner composition, 2 parts by weight, was mixed with carrier particles, 100 parts by weight, consisting of a nickel, zinc, ferrite core available from Titan Advance Materials, Indiana, which contain a continuous coating of a copolymer of vinyl chloride/chlorotrifluorethylene (65/35), and a coating thickness of about 1 micron. About 50 percent by weight of copper iodide was incorporated into the copolymer prior to accomplishing the coating enabling a carrier with a conductivity of $3.9\times10^{-7}$ (ohm-cm)$^{-1}$.

When this developer mixture was roll milled for 1 hour and evaluated in a charge spectrograph, it had an average charge level for 10 micron size particles of 0.77 femtocoulomb per micron, and a standard deviation in the charge of 0.11 femtocoulomb per micron enabling a sharpness value (the average charge divided by the standard deviation) of 7.3. Also, the time for added uncharged toner compositions comprised of the same components identified above to achieve a single peak in a charge spectrograph was about 10 minutes. In addition, the aforementioned developer can be selected for incorporation into a xerographic imaging test fixture with an amorphous selenium photoreceptor, and it is believed that there can be obtained images of excellent resolution with no background deposits.

EXAMPLE II

A toner composition was prepared by repeating the procedure of Example I with the exception that there was selected 92 percent by weight of the copolymer, and further this toner composition had incorporated therein 2 percent by weight of the charge enhancing additive cetyl pyridinium chloride.

Subsequently, the aforementioned prepared toner, 2 parts by weight, was mixed with 100 parts by weight of the carrier particles of Example I, followed by roll milling the resulting developer composition for 1 hour. Thereafter, this developer was evaluated in the charge spectrograph and the average charge level for 10 micron particles (average diameter) was 0.74 femtocoulombs per micron, while the sharpness value was 6.8. In addition, the admix time was 15 seconds. Moreover, when the aforementioned developer composition is incorporated into the imaging test fixture of Example I, it is believed that substantially similar results can be obtained.

EXAMPLE III

A toner composition was prepared by mixing in an extruder device 80 percent by weight of a styrene butadiene copolymer consisting of 90 percent by weight of styrene, and 10 percent by weight of butadiene; which toner had incorporated therein 16 percent by weight of Mapico magnetite, and 4 percent by weight of Regal® 330 carbon black. The resulting toner was then subsequently classified to remove particles having an average particle diameter of less than 5 microns.

Thereafter, a developer composition was prepared by admixing 2 parts by weight of the above prepared toner with 100 parts by weight of the carrier particles of Example I. Subsequently, the developer composition was roll milled for 1 hour, and the developer was evaluated in a charge spectrograph. The average charge level for 10 micron particles was 0.63 femtocoulombs per micron, and the sharpness value was 6.1. In addition, the admix time for uncharged toner comprised of the same components, and added to the above prepared toner was 4 minutes.

EXAMPLE IV

A toner composition was prepared by repeating the procedure of Example I with the exception that there was selected 79 percent by weight of the copolymer, and there was incorporated into the toner composition 1 percent by weight of the charge enhancing additive dimethyl distearyl ammonium methyl sulfate.

Thereafter, a developer composition was prepared by admixing 2 parts by weight of the above prepared toner with 100 parts of the carrier of Example I. This developer was then roll milled for 1 hour, and the developer was evaluated in a charge spectrograph. The average charge level for 10 micron particles was 0.66 femtocoulombs per micron, and the sharpness value was 5.3. In addition, the admix time for this developer was 15 seconds. Further, when the aforementioned developer composition is incorporated into the imaging test fixture of Example I, it is believed that substantially similar results can be obtained.

EXAMPLE V

There was prepared a toner composition by repeating the procedure of Example III with the exception that a polyester resin was selected in place of the styrene butadiene resin. Thereafter, two parts of this toner were admixed with 100 parts of the carrier particles of Example I. The resulting developer was then roll milled for 1 hour, and the developer was evaluated in the charge spectrograph. The average charge level for 10 micron particles was 0.52 femtocoulombs per micron, and the sharpness value was 3.6. In addition, the admix time for uncharged developer was 15 seconds.

Other modifications of the present invention may occur to those skilled in the art subsequent to a review of the present application, and these modifications, including equivalents thereof, are intended to be included within the scope of the present invention.

What is claimed is:

1. A developer composition comprised of a toner composition having dispersed therein resin particles, pigment particles, and carrier components comprised of a core with a polymeric coating thereover, which coating has incorporated therein colorless conductive copper iodide, and wherein the carrier possesses a conductivity of from about $10^{-6}$ to about $10^{-8}$ (ohm-cm)$^{-1}$.

2. A developer composition comprised of a toner composition having dispersed therein resin particles, pigment particles, and charge enhancing additive components; and carrier particles comprised of a core with a polymeric coating thereover, which coating has incorporated therein colorless copper iodide; and wherein the carrier possesses a conductivity of from about $10^{-6}$ to about $10^{-8}$ (ohm-cm)$^{-1}$.

3. A developer composition in accordance with claim 2 wherein the resin particles are styrene polymers.

4. A developer composition in accordance with claim 2 wherein the resin particles are selected from the group consisting of styrene butadiene polymers, styrene methacrylates, styrene acrylates, and polyesters.

5. A developer composition in accordance with claim 2 wherein the pigment particles are carbon black.

6. A developer composition in accordance with claim 2 wherein the pigment particles are comprised of magnetites.

7. A developer composition in accordance with claim 2 wherein the pigment particles are comprised of a mixture of carbon black and magnetites.

8. A developer composition in accordance with claim 2 wherein the pigment particles are present in an amount of from about 1 percent by weight to about 20 percent by weight.

9. A developer composition in accordance with claim 1 wherein the copper iodide is present in an amount of from about 25 to about 75 percent by weight.

10. A developer composition in accordance with claim 2 wherein the copper iodide is present in an amount of from about 25 percent by weight to about 75 percent by weight.

11. A developer composition in accordance with claim 2 wherein the carrier core is comprised of steel or ferrites.

12. A developer composition in accordance with claim 1 wherein the carrier coating is comprised of a vinyl chloride/vinyl acetate copolymer.

13. A developer composition in accordance with claim 2 wherein the coating is comprised of a vinyl chloride/trifluoro chloroethylene copolymer.

14. A developer composition in accordance with claim 2 wherein the coating is comprised of a vinyl chloride/tetrafluoro chloroethylene copolymer.

15. A developer composition in accordance with claim 1 wherein the triboelectric charging value is from about 15 microcoulombs per gram to about 30 microcoulombs per gram.

16. A method of developing electrostatic images comprising forming a latent image on a photoconductive imaging member, contacting the resulting image with the developer composition of claim 1, subsequently transferring the image to a suitable substrate, and fixing the image thereto.

17. A method of developing latent images in accordance with claim 16 wherein the resin particles for the toner composition are styrene polymers.

18. A method of developing latent images in accordance with claim 16 wherein the carrier coating copper iodide is present in an amount of from about 25 to about 75 percent by weight.

19. A method of imaging in accordance with claim 16 wherein the coating for the carrier core is selected from the group consisting of a vinyl chloride/vinyl acetate copolymer and a vinyl chloride/trifluoro chloroethylene copolymer.

20. A method of developing electrostatic images comprising forming a latent image on a photoconductive imaging member, contacting the resulting image with the developer composition of claim 2, subsequently transferring the image to a suitable substrate, and fixing the image thereto.

21. A developer composition in accordance with claim 2 wherein the charge enhancing additive is selected from the group consisting of alkyl pyridinium halides and distearyl dimethyl ammonium methyl sulfate.

22. A developer composition in accordance with claim 20 wherein the alkyl pyridinium halide is cetyl pyridinium chloride.

23. A developer composition in accordance with claim 2 wherein the carrier core is a nickel-zinc-ferrite.

24. A developer composition comprised of a toner composition having dispersed therein resin particles, pigment particles, and carrier components comprised of a core with a polymeric coating thereover selected from the group consisting of copolymers and homopolymers of vinylchloride and trifluoroethylene; Saran F-310; vinylchloride/maleate ester; vinylchloride and vinylacetate; trifluorochloroethylene and vinylidenefluoride; vinylchloride and acrylonitrile; and vinylchloride/chlorotrifluoroethylene, which coating has incorporated therein colorless conductive copper iodide; and wherein the carrier possesses a conductivity of from about $10^{-6}$ to about $10^{-8}$ (ohm-cm)$^{-1}$.

25. A developer composition in accordance with claim 24 wherein the copper iodide is present in an amount of from about 25 to about 75 percent by weight.

26. A developer composition in accordance with claim 24 wherein the carrier core is comprised of nickel, zinc, ferrite, and the coating is comprised of a copolymer of vinylchloride/chlorotrifluoroethylene.

27. A developer composition in accordance with claim 26 wherein the copper iodide is present in an amount of about 50 percent by weight.

28. A developer composition in accordance with claim 24 wherein the resin particles are comprised of styrene butadiene.

29. A developer composition in accordance with claim 24 containing therein charge enhancing additives.

* * * * *